United States Patent [19]

Mochizuki et al.

[11] 4,150,537

[45] Apr. 24, 1979

[54] ELECTRONIC TIMEPIECE AND METHOD FOR TESTING OPERATION OF THE SAME

[75] Inventors: Yoshifumi Mochizuki; Makoto Yoshida, both of Tokorozawa, Japan

[73] Assignee: Citizen Watch Company Limited, Tokyo, Japan

[21] Appl. No.: 843,249

[22] Filed: Oct. 18, 1977

Related U.S. Application Data

[63] Continuation of Ser. No. 664,074, Mar. 5, 1976, abandoned.

[30] Foreign Application Priority Data

Jun. 3, 1976 [JP] Japan ..... 51-29289

[51] Int. Cl.[2] ..... G04B 19/32

[52] U.S. Cl. ..... 58/23 R; 58/85.5

[58] Field of Search ..... 58/23 R, 50 R, 85.5

[56] References Cited

U.S. PATENT DOCUMENTS

| | | | |
|---|---|---|---|
| 3,768,247 | 10/1973 | Fujita | 58/23 R |
| 3,810,356 | 5/1974 | Fujita | 58/23 R |
| 3,834,152 | 9/1974 | Nishimura et al. | 58/23 R |
| 3,886,726 | 6/1975 | Williams et al. | 58/23 R |
| 3,943,696 | 3/1976 | Portmann et al. | 58/23 R |
| 3,953,964 | 5/1976 | Suppa et al. | 58/50 R |

*Primary Examiner*—Robert K. Schaffer
*Assistant Examiner*—Vit W. Miska
*Attorney, Agent, or Firm*—Holman & Stern

[57] ABSTRACT

An electronic timepiece having a multi-digit display of time data and a plurality of frequency divider circuits which generates time data, which comprises operation testing and time correcting means including at least two test terminals, and also a manually operable selecting switch and a manually operable correcting switch. The electronic timepiece also comprises a circuit means which is arranged such that varying combinations of logic level voltages applied to the test terminals can be utilized to test various modes of operation of the frequency divider circuits, a part of such testing being accomplished in conjunction with a signal of relatively high frequency applied to a terminal of one of the manually operable switches.

6 Claims, 10 Drawing Figures

Fig. 8 DISPLAY MODE SWITCHING AND DIGIT CORRECTION

| SWITCH INPUTS | | CONDITION FOLLOWING SWITCH ACTUATION (DISPLAY SWITCHING) |
|---|---|---|
| S 1 | S 2 | |
| 0 | 0 | NORMAL (HOURS AND MINUTES DISPLAY) |
| I PULSE | 0 | (↕) DAYS AND MONTHS DISPLAY |
| I PULSE | 0 | NORMAL (HOURS AND MINUTES DISPLAY) |

| SWITCH INPUTS | | CONDITION FOLLOWING SWITCH ACTUATION (DIGIT CORRECTION) |
|---|---|---|
| S 1 | S 2 | |
| 0 | 0 | NORMAL (HOURS AND MINUTES DISPLAY) |
| 0 | I PULSE | SECONDS CORRECTION MODE |
| N PULSES | 0 | SECONDS DATA INCREMENTED BY N UNITS |
| 0 | I PULSE | MINUTES CORRECTION MODE |
| N PULSES | 0 | MINUTES DATA INCREMENTED BY U UNITS |
| 0 | I PULSE | HOURS CORRECTION MODE |
| N PULSES | 0 | HOURS DATA INCREMENTED BY N UNITS |
| 0 | I PULSE | (↕) MONTHS CORRECTION MODE |
| N PULSES | 0 | (↕) MONTHS DATA INCREMENTED BY N UNITS |
| 0 | I PULSE | (↕) DAYS-OF-MONTH CORRECTION MODE |
| N PULSES | 0 | (↕) DAYS-OF-MONTH DATA INCREMENTED BY N UNITS |
| 0 | I | (↕) WEEKDAYS CORRECTION MODE |
| N PULSES | 0 | (↕) WEEKDAYS DATA INCREMENTED BY N UNITS |
| 0 | I | (↕) YEARS CORRECTION MODE |
| N PULSES | 0 | (↕) YEARS DATA INCREMENTED BY N UNITS |

Fig. 9

TEST MODES

| INPUT FROM EXTERNAL HIGH FREQUENCY SOURCE (VIA S2 TERMINAL) | LEVELS OF TEST TERMINALS | | | TEST MODE NUMBER | TEST CONDITION |
|---|---|---|---|---|---|
| | $T_1$ | $T_2$ | $T_3$ | | |
| | 0 | 0 | 0 | 1 | NORMAL DISPLAY CONDITION |
| | 1 | 0 | 0 | 2 | SECONDS DATA UNCONDITIONALLY RESET TO ZERO. DISPLAY RETURNED TO HOURS/MINUTES CONDITION IF MONTHS/YEARS STATE. |
| | 1 | 1 | 0 | (8) | SAME AS FOR MODE 2 |
| | 0 | 1 | 0 | 3 | COUNTER OF DATA SELECTION CIRCUIT FORCIBLY RESET TO ZERO, CAUSING RETURN OF DISPLAY TO HOURS/MINUTES CONDITION. |
| | 1 | 1 | 1 | 4 | ALL COUNTERS RESET TO ZERO. TIME DATA BECOMES 12.00.(00 secs.) A.M. SUNDAY 1st DEC. YEAR 0. |
| N PULSES | 1 | 0 | 1 | 5 | ALL COUNTERS SIMULTANEOUSLY INCREMENTED BY N UNITS. |
| N PULSES | 0 | 0 | 1 | 6 | N PULSES INPUT TO SECONDS COUNTER. COMBINED OPERATION OF SECONDS, MINITES AND HOURS COUNTER CAN BE CHECKED. |
| N PULSES | 0 | 1 | 1 | 7 | N PULSES INPUT TO DAYS-OF-MONTH AND WEEKDAYS COUNTERS. COMBINED OPERATION OF DAYS, MONTHS AND YEARS COUNTERS CAN BE CHECKED. |

ELECTRONIC TIMEPIECE AND METHOD FOR TESTING OPERATION OF THE SAME

This is a continuation of application Ser. No. 664,074, filed Mar. 5, 1976, now abandoned.

This invention relates generally to electronic timepieces, and more particularly to a method and apparatus for testing electronic timepieces incorporating digital displays, such as wristwatches, to confirm that they are operating correctly, and for correcting the time data displayed by such wristwatches.

In an electronic wristwatch, it is normal practice to produce time data such as minutes, hours, days and years by dividing the frequency of a signal from a standard oscillator in a series of frequency divider counter circuits. In order to test that these counter circuits are functioning correctly at the time of manufacture of the wristwatch, it has heretofore been necessary to provide a separate terminal connected to each counter circuit whereby a suitable test signal can be applied. This has the disadvantage of increasing the number of terminal pads which must be provided on the integrated circuit chip of the wristwatch. Another disadvantage is that the sequential testing of each counter circuit is time consuming, and so increases manufacturing costs. Accordingly, it is desirable to produce an electronic timepiece, in particular a wristwatch, in which means are provided whereby the functioning of the timepiece can be quickly and easily tested at the time of manufacture, and whereby the number of connections to the integrated circuit chip which must be made for such testing can be reduced. In addition, it is desirable to provide means whereby a plurality of categories of time data can be easily corrected by the wearer utilizing only a small number of external switches, from considerations of case size.

Accordingly, it is an object of the present invention to provide an improved electronic timepiece for which the operation may be quickly and easily tested and the displayed time data quickly and easily corrected.

It is another object of the present invention to provide an improved electronic wristwatch incorporating two or more test terminals for performing tests of the operation of the wristwatch, the number of possible tests being greater than the number of test terminals.

Still another object of the present invention is to provide an improved electronic wristwatch incorporating a simple circuit arrangement whereby the operation of the wristwatch may be easily and quickly tested and the displayed time data quickly and easily corrected.

Generally speaking, in accordance with the invention, an electronic timepiece having a multi-digit display of time data and a plurality of frequency divider circuits which generate the time data, is provided with operation testing and time correcting means including at least two test terminals, and also a manually operable selecting switch and a manually operable correcting switch. The circuit means is adapted such that varying combinations of logic level voltages applied to the test terminals can be utilized to test various modes of operation of the frequency divider circuits, a part of such testing being accomplished in conjunction with a signal of relatively high frequency applied to a terminal of one of the manually operable switches only while such testing is being performed. The circuit means is also adapted such that, by a sequence of operations of the manually operable switches, each digit of the multi-digit display may be individually selected for correcting purposes and subsequently corrected by the wearer of the timepiece. In addition, operation is such that the digit which has been selected for correction is indicated to the wearer, by such means as causing the displayed selected digit to flash on and off periodically.

These and further objects, features and advantages of the invention will be more apparent from the following description when taken with the accompanying drawings, wherein.

Figure 1:
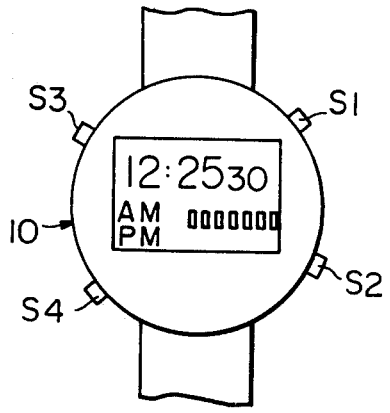
FIG. 1 is a view of the face of a watch in accordance with an embodiment of the present invention.
Figure 2:
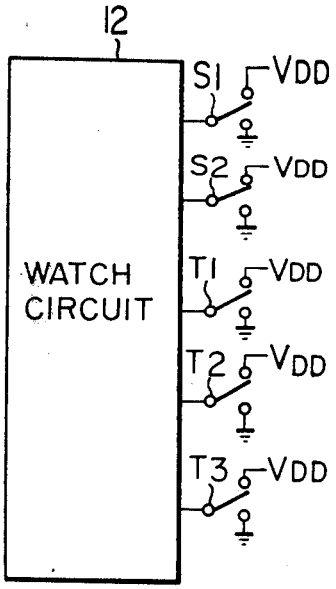
FIG. 2 is a block diagram illustrating the operation of test terminals and switch terminals for the wristwatch of FIG. 1 in accordance with the invention.
Figure 3A:
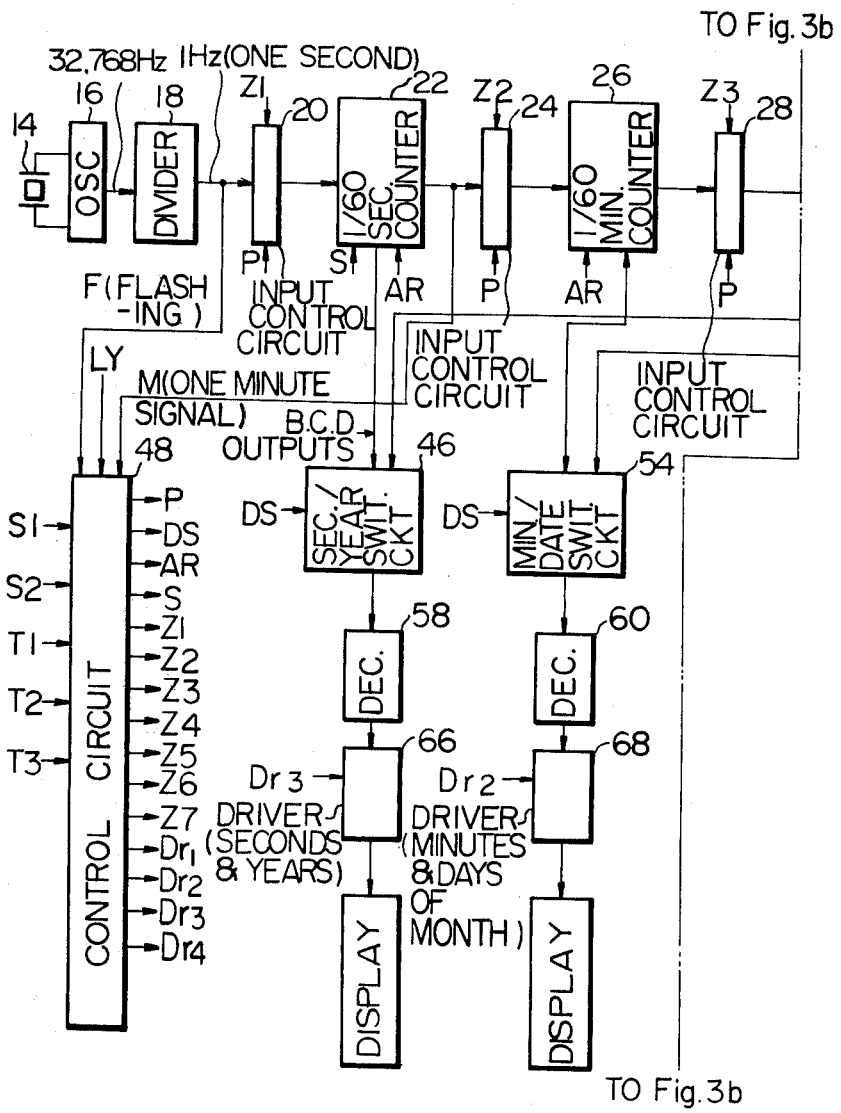
Figure 3B:
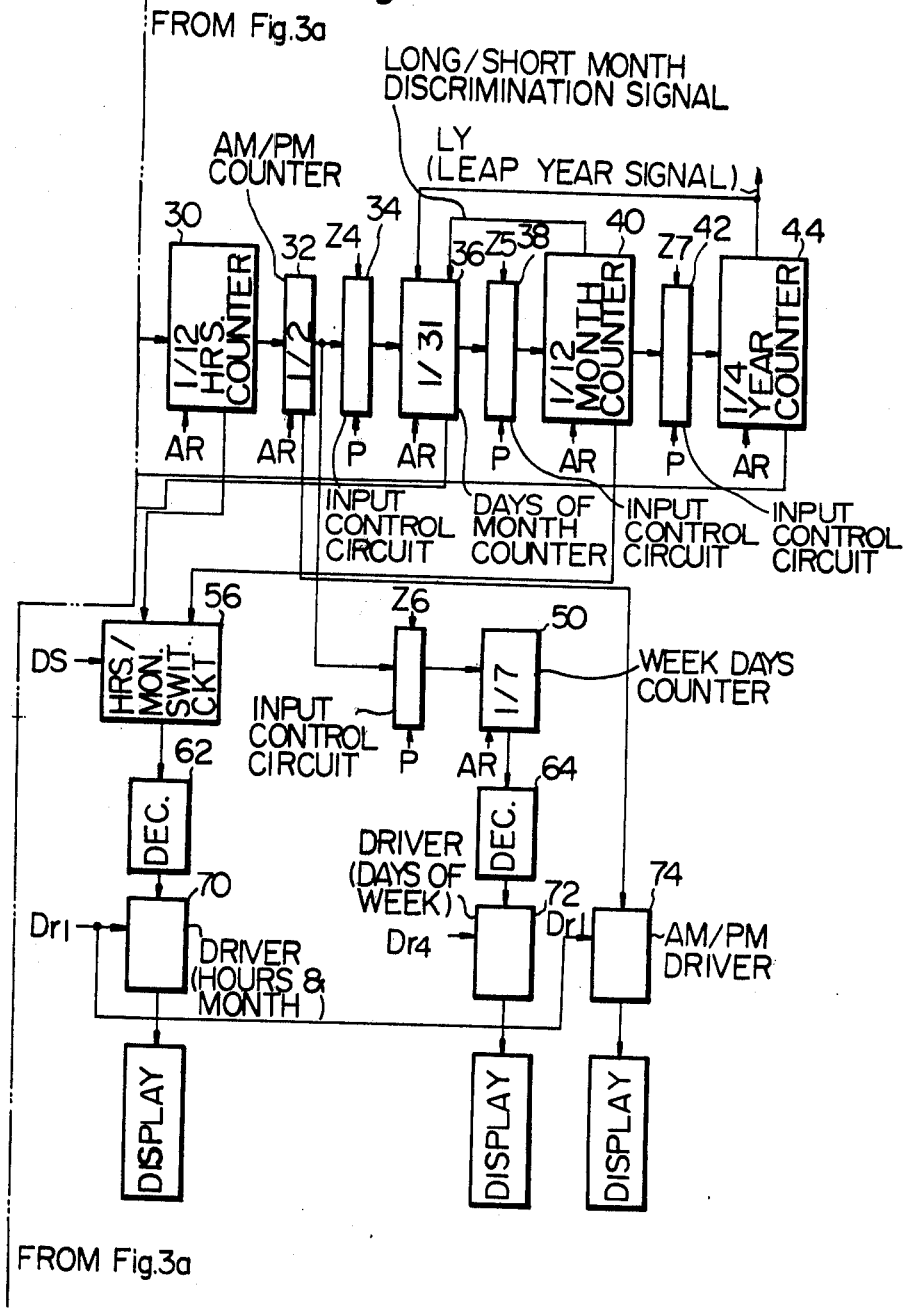
Figure 4:
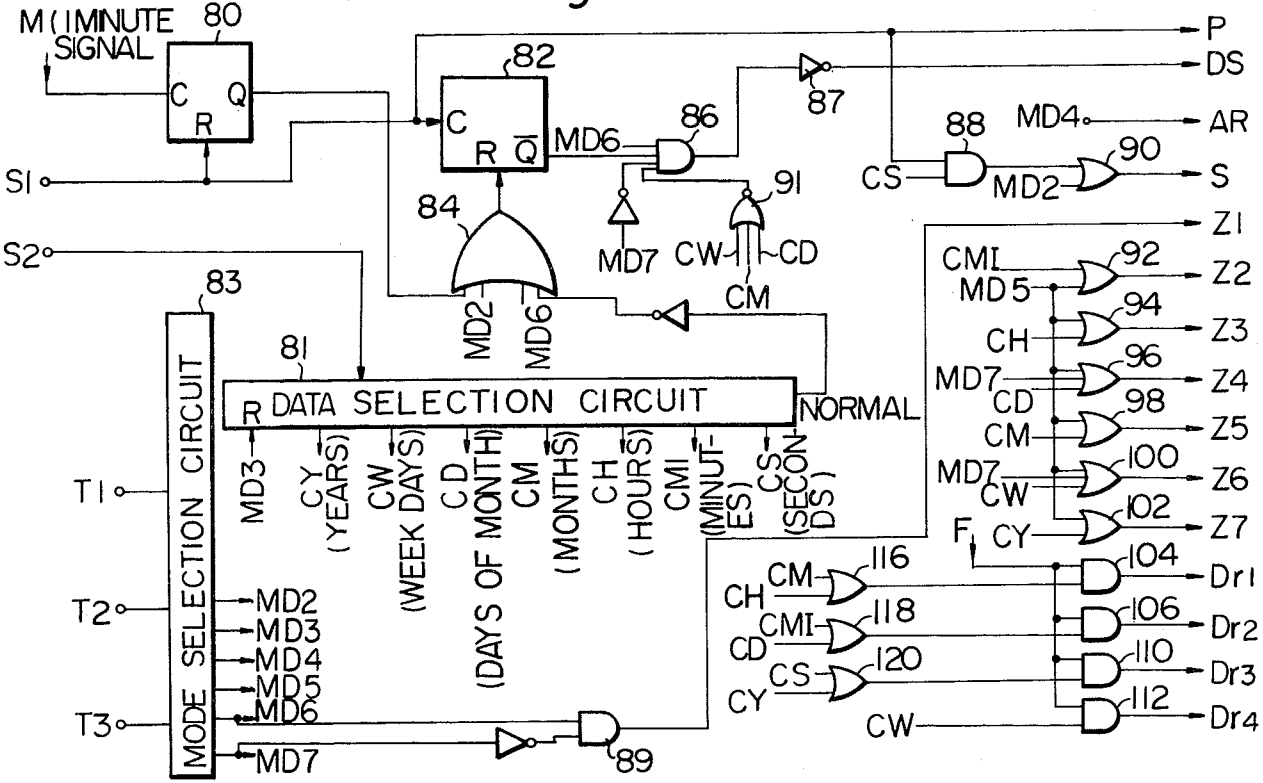
Figure 5:
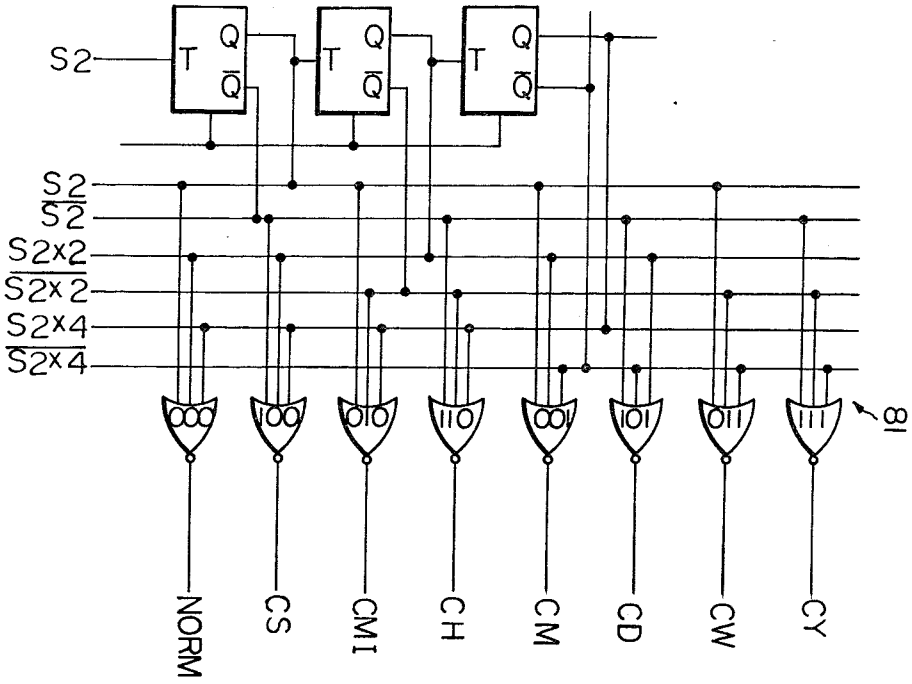
Figure 6:
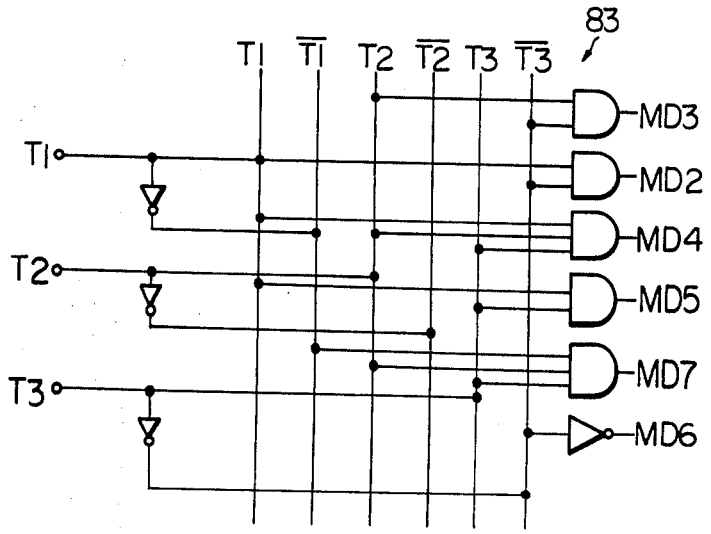
Figure 7:
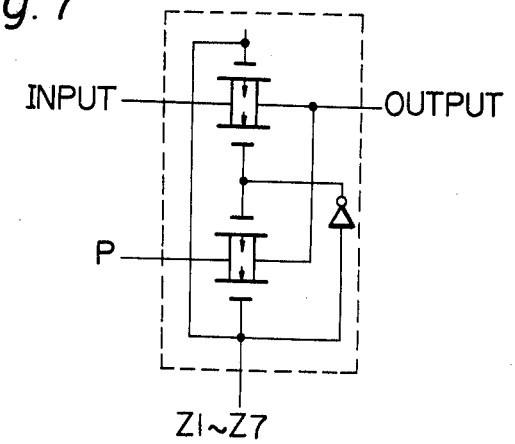

FIGS. 3*a* and 3*b* show an overall block diagram of the electronic wristwatch of FIGS. 1 and 2 constructed in accordance with the present invention;

FIG. 4 is a block diagram showing the operation of the circuits which enable testing of operation and correction of displayed time data to be performed for the electronic wristwatch of FIGS. 1 and 2;

FIG. 5 is a circuit diagram of a part of the circuitry, referred to herein as a data selector circuit, which serves to select the time data for which correction is to be applied, in the wristwatch of FIGS. 1 and 2, this selection being performed by repeated actuation of a switch S2 indicated in FIG. 1;

FIG. 6 is a circuit diagram of a part of the circuitry, referred to herein as a mode selection circuit, which serves to select various test modes, in accordance with combinations of test voltages applied to a set of test terminals, these voltages being applied in a manner illustrated in the block diagram of FIG. 2;

FIG. 7 is a view showing an example of a control input circuit of FIGS. 3*a* and 3*b*;

FIG. 8 is a table showing the relationship between the actuations of switches S1 and S2 shown in FIG. 1 and the resultant selection and correction of time data in accordance with the invention; and FIG. 9 is a table showing the relationship between the various combinations of test voltages applied to the terminals T1 to T3 shown in FIG. 1 and the resultant test modes, in accordance with the invention.

Referring now to FIG. 1, an electronic wristwatch 10 is illustrated with a digital display adapted to display either hours, minutes and seconds time data or days of the month, month and year time data, either category of data being selectable by the wearer. Whichever of these two categories is selected, days of the week data is continuously displayed. It is understood that the display means is based on the use of light-emitting diodes and the like.

Four push button type switches are mounted around the rim of the watch case. Of these, when S4 is depressed the seconds data of the watch is reset to zero. When S3 is depressed with the "correction" condition, the display is changed to display hours/minutes data. The operation of these switches S3 and S4 is not important to the invention, and they will not be described further. Switches S1 and S2 are used by the wearer to correct the various time data displayed, and also to change the display from the hours/minutes to the days/months condition and vice-versa. Of these, S1 is used to change the display mode from hours/minutes to months/days, and also to correct digits of the display. The term digits as used herein can refer to one of the two digits representing each of the seconds, minutes, hours, days of month and months displays or to both of the digits. It can further refer to the display of one of the days of the week or to all of the days of the week. The switch S2 is used to select the digit to be corrected. Each time switch S2 is actuated, the digitselected digit selected correction is changed, in a sequence of the kind shown in FIG. 8. The selection of a particular digit causes that digit to flash on and off periodically on the display, to indicate selection.

As shown in FIG. 8, if S1 is depressed once, the display is changed from hours/minutes to the months/-days condition, and if S1 is again depressed shortly thereafter the display is returned to the original condition of hours/minutes. If S1 is not depressed a second time, then the display will be automatically returned to the hours/minutes condition after two minutes have elapsed from the initial actuation of S1.

With the display in the hours/minutes condition, if switch S2 is depressed once then the watch is brought into the "seconds correction" condition. When S1 is then depressed once, the seconds are reset to zero. If the seconds count was within the range 1 to 29 before resetting, then the minutes display is not changed. If the seconds are within the range 30 to 59, however, then a carry signal is generated such that the minutes are advanced by one. Thus, a display of, for example, 5.16 will be changed to 5.00, i.e. five minutes and zero seconds, whereas 5.42 will be changed to 6.00, i.e. six minutes and zero seconds, after seconds zeroing.

If S2 is now depressed again, the watch will be brought into the "minutes correction" condition. Each time that S1 is depressed thereafter will cause the minutes data to be incremented by one. In order to facilitate this correction process, the carry function from the minutes to the hours data is inhibited while correction is taking place.

If now S2 is depressed once more, the "hours correction" condition will be introduced, so that the hours data can be incremented by depressing S1. Carry to the days data is similarly inhibited.

If S2 is depressed again, the months/days display will appear, and the "months correction" condition will be introduced. Similarly, the next depression of S2 brings the "days of the month correction" condition, and a subsequent depression of S2 the "days of the week correction" condition. The next depression of the switch S2 brings the "year correction" condition. When the watch is in the months/days display condition, the display digit normally used for seconds display is utilized to show the relationship of the current year to the leap year cycle. A leap year is given the designation of the numeral "0", while subsequent years are designated by the numerals 1, 2 and 3. This data can be changed with the watch in the "year correction" condition, by repeated actuations of S1 as for the other display digits. A further actuation of S2 will cause the watch to be returned to the normal hours/minutes display condition.

Referring now to FIG. 2, there is shown a watch circuit 12 having switch terminals S1 and S2, and also test terminals T1 to T3, which are, as shown, normally connected to a potential $V_{DD}$, referred to in the charts of FIGS. 8 and 9 as level "0". When actuated, these terminals are connected to the case ground of the watch, a higher potential than $V_{DD}$. Thus ground potential is referred to as level "1".

A block diagram showing the general features of an electronic timepiece in accordance with the invention is given in FIG. 3. A high frequency time standard signal of, for example, 32,768 Hz, is output from an oscillator circuit 16 controlled by a quartz crystal 14 and frequency-divided by a divider circuit 18 to give a 1 Hz signal, i.e. one pulse per second. This signal is similarly subsequently frequently-divided by a chain of counter circuits. Of these, counter 22 divides the seconds by sixth to give a minutes output. Counter 26 divides the minutes by sixth to give an hours output. Counter 30 divides the hours by twelve to give a twelve-hours output. Counter 32 divides the twelve-hours output by two to give an AM/PM i.e. days output. Counter 36 divides the days output by 28, 29, 30 or 31 (depending upon the month and whether the year is a leap year) to give a months output. Counter 40 divides the months by twelve to give a year output. The output of counter 32 is also applied to counter 50, which counts days of the week. Counter 44 divides by 4 to count leap years and provides an output control signal which is applied to counter 36 to control the count therein for February of a leap year.

Between each of these above-mentioned counter circuits and the preceding stage is inserted an input control circuit, designated by one of the numerals 20, 24, 28, 34, 38, 42 and 52. Each control circuit has an input connected to a preceding stage such as a divider or counter, an output connected to a subsequent stage, and a control terminal, designated by one of the symbols Z1 to Z7 as shown in FIG. 7. When the corresponding control terminal is set to the logic level "0," then the signal from the preceding counter stage appears at the control circuit output, but when the control terminal is set to the "1" level, the input signal P appears at the control circuit output. The function of P will be explained in a subsequent portion of this description.

Referring to block 46, this is one of a set of display switching circuits, whereby the display can be changed from the hours/minutes to the days/months condition, by changing the level of a switching signal DS from the "0" level to the "1" level. The output of the seconds counter 22 and the year counter 44 are applied to display switching circuit 46, so that when the days/months condition is selected by signal DS, the leap year count of 0 to 3 will appear in place of the seconds digit display. Similarly circuits 54 and 56 select minutes/days of month and hours/months respectively, controlled by signal DS. The outputs of the latter display switching circuits, and days of week counter 50 are applied to a set of display decoder circuits 58, 60, 62 and 64. The outputs of the display decoder circuits and the output of AM/PM counter 32 are applied to a set of display drivers 66, 68, 70, 72 and 74, each of which can be controlled by one of a set of display modulation signals DR1 to DR4, to cause flashing of the corresponding display digit when this digit is selected for correction.

Block 48 of FIGS. 3*a* and 3*b* is a control circuit, which generates outputs to correct selected time data in accordance with actuations of switches S1 and S2, as described above. This circuit also generates various test mode signals, in accordance with combinations of voltage levels applied to terminals T1 to T3, as well as the display modulation signals DR1 to DR4.

FIG. 4 is a block diagram of control circuit 48 in FIG. 3. It is based on a data selection circuit, shown in greater detail in FIG. 5, and a mode selection circuit shown in FIG. 6. Referring to FIG. 5, it can be seen that switch terminal S2 is connected to a three-stage binary counter, whose count states are decoded to give eight outputs. The counts of zero to eight thus decoded actuate the selection of the normal condition, the "seconds correction," "minutes correction," "hours correction," "months correction," "days of month correction," "days of week correction," and "year correction" conditions respectively. These decoded signals are indicated in the figures as CS(seconds), CMI(minutes), CH(hours), CM(months), CD(days of month), CW(week days) and CY(years) selection signals, respectively. Each time switch S2 is depressed, a "0" to "1" transition takes place at the T input of the first binary counter stage, thereby incrementing the count by one and changing the selection signal to the next in sequence.

Referring again to FIG. 4, S1 input terminal is shown connected to the input terminal of a flip-flop 82, whose $\overline{Q}$ output is applied to gate 86 to generate a "1" level DS signal through an inverter 87 when S1 is depressed. The display is thereby changed from the hours/minutes to the days/months condition. The depression of S1 has simultaneously reset a divide-by-two counter circuit 80, to which the one-minute output signal from seconds counter 22 in FIG. 3 is applied. A second actuation of S1 will return the $\overline{Q}$ output of flip-flop 82 to the "1" state, to return the display to the hours/minutes state. If S1 is not depressed a second time, the next one-minute pulse applied to 80 will generate a "1" level $\overline{Q}$ output signal, thereby resetting flip-flop 82 via OR gate 84. The DS signal is thus returned to the "0" level, and the display of hours/minutes replace days/months. Note that the inverted "normal" selector signal is applied to the reset terminal of flip-flop 82 through OR gate 84, so that when the watch is in a correction condition, depressing S1 cannot affect the DS signal level.

The first time S2 is depressed, the "seconds" selection signal is generated by selector circuit 81 and applied to AND gate 88. Thus when S1 is then depressed to cause seconds zeroing, a signal P is applied to the other input of gate 88, to generate an output signal, which in turn is output from OR gate 90 as signal S. Signal S is applied to the seconds counter (22 in FIG. 3*a*), to zero the seconds data.

The next depression of S2 causes a "minutes" selection signal to be generated by selector circuit 81. This is applied to OR gate 92, producing an output signal Z2 which is applied to the input control circuit 24 in FIG. 3. As a result, the P signal which is input to circuit 24 is applied to the input of the minutes counter 26. Since P varies with the level of switch terminal S1, each time S1 is depressed the minutes counter will be advanced by one unit. Incrementing of the other counter circuits for correction purposes is performed in a similar manner to that described for the minutes counter, by generating control signals Z2 to Z7 from the corresponding correction signals.

FIG. 6 shows the mode selection circuit, which generates a sequence of test mode selection signals Mode 1 to Mode 8 (designated MD 1 to MD8 in the figures), in accordance with a sequence of varying combinations of voltage levels applied to test terminals T1 to T3. Mode 1 is not a specifically generated signal, but merely indicates the normal operating state where terminals T1 to T3 are at "0" level. The functions of the other test mode signals are summarized in FIG. 8, but will now be explained with reference to FIG. 4.

The mode 2 signal (generated when only T1 terminal is set to "1" level) is applied to OR gate 90, generating signal S and thereby setting the seconds data to zero, as described above. The Mode 3 signal (generated when only T2 terminal is set to "1"), is applied to the RESET terminals of the binary counter in data selector circuit 81, so that the "normal" output signal is erased. The display condition is thereby returned to the normal hours/minutes condition if it is in the correction condition. When the watch is in the "days of month correction," "days of week correction" and "months correction," the decoded signals CD, CW and CM are applied through NOR gate 91 to inhibit gate 86 so that data selection signal DS is changed to "1" level by inverter 87 to display days/months data.

The Mode 4 signal (generated when terminals T1 to T3 are all in the "1" state) is applied to each counter, except for divider 18, with the designation AR meaning "all reset". The counters are thereby reset simultaneously to zero. The hours/minutes and days/months data will then be 12.00 (+ 00 seconds) A.M., 1st December, year 0 (i.e. a leap year) and Sunday.

Before performing tests utilizing modes 5, 6 and 7, a source of a relatively high frequency signal, for example 8 Hz, is connected temporarily to input switch terminal S1. The Mode 5 signal (generated by setting T1 and T3 to the "1" state and leaving T2 in the "0" state) is applied to OR gate 92, producing signal Z2, as well as to OR gates 94, 96, 98, 100 and 102 generating signals Z3 to Z7. Signal P, now at a high frequency, is thereby applied simultaneously to the inputs of counters 26, 30, 36, 40, 44 and 50 shown in FIGS. 3*a* and 3*b*.

The Mode 6 signal (generated by setting only terminal T3 to the "1" state) produces a "1" level of signal Z1. This results in the high frequency P signal being applied only to the input of the seconds counter 22 in place of the normal 1 Hz input from the preceding divider 18. Since the other counter circuits are left connected in series, the combined operation of these counters can be rapidly tested.

The Mode 7 signal (generated by setting only T2 and T3 to the "1" level) is applied via an inverter to AND gate 89 to inhibit generation of Z1. It is also applied to OR gates 96 and 100, causing signals Z4 and Z6 to go to the "1" level. Thus, high frequency signal P is now applied to the inputs of days-of-month counter 36 and weekdays counter 50, so that the functioning of these counters and also the months and years counters 40 and 44 can be quickly tested.

The condition of only T1 and T2 being set high, i.e. Mode 8, causes the Mode 2 signal described above to be generated. The Signal F, shown connected to AND gates 104 to 112 in FIG. 4 serves to generate modulation signals DR1 to DR4. These are applied to drive circuits 66, 68, 70, 72 and 74 shown in FIGS. 3*a* and 3*b* to cause flashing of selected digits. Selection of the modulation signals DR1 to DR4 is accomplished by OR gates 116, 118 and 120 shown in FIG. 4, whose outputs are applied to AND gate 104, 106 and 110 and by the weekdays selection signal applied directly to AND gate 112. When hours correction is being performed, for example, a corresponding selection signal output from the data selection circuit 81 is applied to OR gate 116, causing DR1 to be produced and thereby flashing of the hours display digit. Since the months digit occupies the same display position as the hours digit, during the days/months display condition, the "months" selection signal is applied to the same OR gate 116 as the "hours" selection signal. For the same reason, the "minutes" and "days" selection signals are applied to OR gate 118, and the "seconds" and "years" selection signals to OR gate 120. DR4 is generated only when weekdays correction occurs, and DR1 is used to cause AM/PM symbol as well as hours/months digit flashing.

By the foregoing arrangement, three test terminals and a switch terminal permit the testing of counter circuits which count seconds, minutes, hours, days-of-the month, leap years and days-of-the week for a timepiece incorporating a digital display such as a light-emitting diode display, such that these counter circuits may be tested separately and also while functioning in combination. In addition, by the foregoing arrangement, two external switches permit correction of any displayed time indicating digit, thereby reducing the number of such switches conventionally utilized. Further, the switches S3 and S4 may be connected to terminals T2 and T1, respectively, to permit the wearer to perform functions similar to Mode 3 and Mode 2 as described above.

It will thus be seen that the objects set forth above, and those made apparent from the preceding description, are efficiently attained, and since certain changes may be made in the above construction without departing from the spirit of the invention, it is intended that all matter contained in the above description or shown in the accompanying drawings shall be interpreted as illustrative and not in a limiting sense. It is also to be understood that the following claims are intended to cover the generic and specific features of the invention herein described, and all statements of the scope of the invention which, as a matter of language, might be said to fall therebetween.

What is claimed is:

1. In an electronic timepiece having a power source, and a watch circuit chip comprised of an oscillator circuit, a divider circuit connected to the oscillator circuit, a plurality of counter circuits connected in series with the divider circuit to provide time data, and a driver circuit connected to the counter circuits to cause display means to effect a display of said time data, an improvement comprising:

a manually operable correction switch;

a manually operable selection switch;

a plurality of test mode selection terminals externally provided on said circuit chip, said terminals adapted to be selectively supplied with logic signals in a predetermined mode during a test condition to effect selection of one of a plurality of operational characteristics of said timepiece for testing based upon said predetermined mode;

a test mode selection circuit comprised of a plurality of gate means connected to said plurality of test mode selection terminals to generate a plurality of test mode selection signals, indicative of said plurality of operational characteristics in accordance with varying combinations of logical values of said logic signals;

a data selection circuit connected to said selection switch for generating a sequence of data selection signals in response to sequential operation of said selection switch;

control signal generating means comprised of a plurality of gate means having first inputs coupled to said data selection circuit to receive said data selection signals for thereby producing a plurality of control signals in response thereto; and a plurality of input control circuits each connected to an input of each of said counter circuits and having an input terminal connected to said correction switch to receive an input signal therefrom, said input control circuits being responsive to said control signals to apply said input signal to said counter circuits to update the counts of said counter circuits;

said plurality of gate means of said control signal generating means having second inputs coupled to said test mode selection circuit, selected ones of said plurality of gate means of said control signal generating means being simultaneously responsive to at least one of said test mode selection signals to concurrently generate said control signals, whereby selected ones of said plurality of input control circuits are concurrently rendered operative to allow testing of combined operational characteristics of selected ones of said plurality of counter circuits.

2. An electronic timepiece according to claim 1, in which said counter circuits have reset terminals, and said mode selection circuit generates a reset signal in response to one of said varying combinations of said potentials at said test terminals, said reset signal being applied to said reset terminals simultaneously whereby all of said counter circuits are simultaneously reset to zero.

3. An electronic timepiece according to claim 1, in which said input signal has a relatively high frequency.

4. An electronic timepiece according to claim 1, in which each of said plurality of gate means has at least two inputs, one input connected to said mode selection circuit and another input connected to said data selection circuit.

5. An electronic timepiece according to claim 1, in which said data selection circuit comprises:

a binary counter means connected to said selection switch for generating various output signals in dependence on the number of operations of said selection switch; and decoder means, connected to said binary counter, for decoding the output signals from said binary counter and for generating said data selection signals.

6. An electronic timepiece according to claim 1, further comprising means for generating display modulation signals in response to said data selection signals to cause flashing on and off of a corresponding display digit when this digit is selected for correction by one of said data selection signals.

* * * * *